US005402594A

United States Patent [19]

Switzer

[11] Patent Number: 5,402,594

[45] Date of Patent: Apr. 4, 1995

[54] MAGAZINE CARTRIDGE LOADER

[76] Inventor: Robert D. Switzer, 2200 N. Ft. Thomas Ave., Ft. Thomas, Ky. 41075

[21] Appl. No.: 222,415

[22] Filed: Apr. 1, 1994

[51] Int. Cl.[6] ..... F41A 9/83

[52] U.S. Cl. ..... 42/90; 42/87

[58] Field of Search ..... 42/50, 87, 90

[56] References Cited

U.S. PATENT DOCUMENTS

| | | | |
|---|---|---|---|
| 1,245,499 | 11/1917 | Orme | 42/90 |
| 2,137,491 | 11/1938 | Huff | 42/90 |
| 2,514,277 | 7/1950 | Donallan | 42/90 |
| 2,862,324 | 12/1958 | Ball | 42/50 |
| 2,864,193 | 12/1958 | Drew | 42/87 |
| 2,885,811 | 5/1959 | Womble, Jr. | 42/50 |
| 3,509,655 | 5/1970 | Wilhelm | 42/87 |
| 4,488,371 | 12/1984 | Boyles | 42/90 |
| 4,827,651 | 5/1989 | Conkey | 42/87 |
| 4,829,693 | 5/1989 | Holmes | 42/87 |
| 4,872,279 | 10/1989 | Boat | 49/90 |
| 4,993,180 | 2/1991 | Upchurch | 42/87 |
| 5,074,070 | 12/1991 | Kuykendall | 42/90 |
| 5,129,173 | 7/1992 | Kuykendall | 42/90 |
| 5,249,386 | 10/1993 | Switzer | 42/87 |

*Primary Examiner*—Charles T. Jordan
*Assistant Examiner*—Theresa M. Wesson
*Attorney, Agent, or Firm*—Wood, Herron & Evans

[57] ABSTRACT

A cartridge loader for a cartridge clip as disclosed. The loader includes a loader sleeve slidingly receivable on the magazine to compress the clip's spring in order to permit easy re-loading of the clip. A brake connected to the sleeve co-acts with the magazine's sidewall surface so as to impede the sleeve from disengagement with the magazine in the event the sleeve is inadvertently released by a user when the clip's spring is compressed and with no cartridges present in the clip. In preferred form, the brake is comprised of a brake arm that causes the sleeve to slide in a frictional braking relation with the clip's sidewall surface and that itself slides in a frictional braking relation with the clip's sidewall surface.

10 Claims, 1 Drawing Sheet

MAGAZINE CARTRIDGE LOADER

This invention relates to guns. More particularly, this invention relates to an improved cartridge loader for magazine clips used with guns.

Guns, particularly hand guns such as pistols, are commonly structured to receive cartridge clips. The cartridge clip carries a series of cartridges or bullets and is adapted to feed those bullets one at a time in succession to the gun's firing chamber. This cartridge clip approach to hand guns allows a hand gun to fire a series of cartridges, e.g., ten or twelve or more, without need for hand loading cartridges one at a time to the gun. And the cartridge clip allows plural cartridges, e.g., ten or twelve or more, to be easily loaded in proper firing sequence with the gun simply by loading a single clip into the gun.

The basic structure of a cartridge clip includes a magazine with an ejection end and a closed end in combination with a compression spring positioned within that magazine. The cartridges are loaded sequentially within the magazine against the compression force exerted by the spring. Once loaded in the magazine, the cartridges are spring loaded toward the ejection end for subsequent ejection therefrom when the clip is loaded in a gun.

A substantial compression spring force must be available in a cartridge clip in order to properly move a succeeding cartridge in sequence to the magazine's ejection end after a preceding cartridge has been ejected from the magazine. When the magazine is reloaded, i.e., after all cartridges have been ejected from the magazine, the compression spring must be compressed in response to the sequential loading of each individual cartridge until the clip's maximum cartridge supply is received. Now the more cartridges that are put into the clip, the greater the resistance of the compression spring against further compression. And this means that the last cartridge loaded into the magazine is significantly harder to load than the first cartridge loaded into the magazine.

Therefore, it has been the primary objective of this invention to provide an improved magazine cartridge loader for a cartridge clip, the loader being provided with a brake that cooperates with the magazine so as to impede the loader from disengagement with the magazine in the event the loader is inadvertently released by a user during use when the loader has depressed the clip's compression spring and when no cartridges are present in the clip.

In accord with this objective, and for a cartridge clip of the type having a magazine with a follower biased toward an ejection end by a compression spring, a thumb pin fixed to the follower and extending through a longitudinal slot located in a sidewall of the magazine, and the follower being drawn toward a closed end of the magazine against the compression spring by pushing the pin toward that closed end, the improved cartridge loader of this invention takes the form of a loader sleeve slidingly receivable on the magazine with the sleeve being slidable on the magazine from a first position to a second position to compress the spring in order to permit easy reloading of the clip. The sleeve co-acts with the thumb pin as the sleeve slides from the first to the second position. A brake is connected with the sleeve, the brake coacting with a sidewall surface of the magazine so as to impede the sleeve from disengagement with the magazine in the event the sleeve is inadvertently released by a user at any location between the first and second positions when no cartridges are present in the clip.

Other objectives and advantages of this invention are more apparent from the following detailed description taken in conjunction with the drawings in which.

Figure 1:
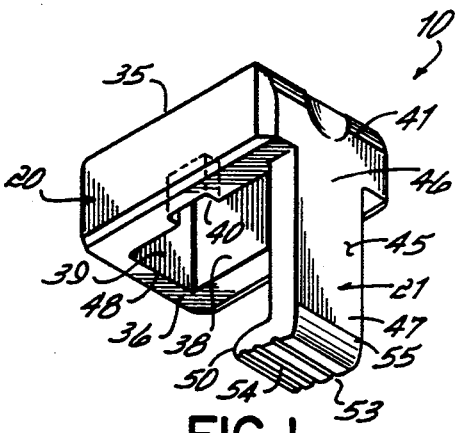
FIG. 1 is a bottom perspective view of a magazine loader in accord with the principles of this invention.
Figure 2:
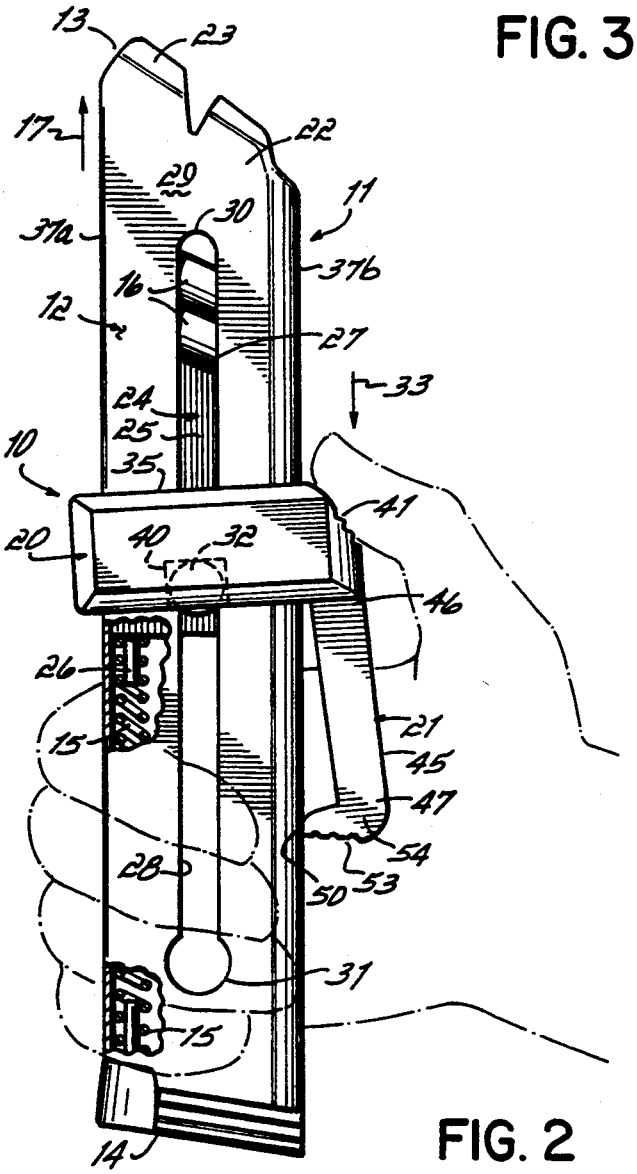
FIG. 2 is a side elevation view illustrating a cartridge clip with the magazine cartridge loader in operational assembly therewith, the magazine cartridge reloader being in braking relation with the cartridge clip.

A magazine cartridge loader 10 in accord with the principles of this invention is adapted for use with a cartridge clip 11 of the kind shown in FIG. 2. The cartridge clip 11 basically includes a magazine 12 with an ejection end 13 and a closed end 14. A compression spring 15 is positioned within the magazine 12, cartridges 16 that are loaded into the magazine being spring loaded in the direction shown by arrow 17 toward the magazine's ejection end 13 for subsequent ejection therefrom when the clip 11 is installed with a gun (not shown). The magazine cartridge loader 10 of this invention, which is used in order to cause compression of the compression spring 15 in order to make easier the reloading of the cartridge clip 11 with cartridges 16, is particularly shown in FIG. 1. The magazine cartridge reloader 10 basically comprises a loader sleeve 20 and a brake 21, the details of which will be described in detail below and which are particularly illustrated in the figures.

As shown in the figures the clip's magazine 12 is in the form of a tubular housing 22 having an open end 13 with flared sidewalls 23 that neck down to define an ejection slot at that open end 13. The compression spring 15 is in the form of a coil spring which seats against a cartridge follower 24. The cartridge follower 24 is comprised of a follower block 25 and a stem 26, the stem being received in the top loops of the compression spring 15. The follower 24 includes an upper surface 27 against which the lowest cartridge 16 rests when the clip 11 is at least partially full. Additionally, the cartridge clip 11 includes a longitudinal slot 28 in one sidewall 29 that runs from a first end 30 adjacent the clip's open end 13 to a second end 31 adjacent the clip's closed end 14. This longitudinal slot 28 allows thumb pin 32 fixed to the follower block 25 to extend outwardly of the magazine's sidewall 29 surface for manual contact. Without the magazine cartridge loader 10 of this invention, the magazine's thumb pin 32 must be manually depressed with a user's thumb in a direction shown by arrow 33 (FIG. 4) in order to depress the magazine's follower 24 against the compression spring 15 to allow reloading of the cartridge clip. But this is not easy for a user because the small pin 32 tends to hurt the user's thumb in the first place, and the strong force of the compression spring 15 makes it difficult to depress that pin and, thereby, the follower against the compression spring in the second place.

The magazine cartridge loader 10 of this invention, as illustrated in FIGS. 1–4, includes a loader sleeve 20 slidingly receivable on the magazine 11. The sleeve 20, which is a closed sleeve in the sense it defines a closed loop open at its top edge 35 and bottom edge 36 only, is slideable on the magazine from a first position adjacent the clip's ejection end 13 to a second position adjacent the clip's closed end 14 to compress the spring 15 in order to permit easy reloading of the clip 11. The sleeve 20 itself is provided with cross-sectional configuration and dimensions, relative to the cross-sectional configuration and dimensions of the magazine, that will allow the sleeve 20 to slide freely along the magazine's sidewalls 29 and end wall surfaces 37*a* if the brake 21 of this invention was not included. In other words, the length of the loader sleeve's inner sidewalls 38 and the breadth of the sleeve's inner end walls 39 is such, relative to the length and breadth of the magazine's sidewalls 28 and end walls 37*a*, 37*b* respectively, that without the brake 21 of this invention the sleeve would slide freely along the magazine's wall surfaces.

The loader sleeve 20 also includes a seat 40 defined on the inner surface of one sidewall 38 at the bottom edge 36 thereof, this seat 40 being adapted to cooperate with the magazine's thumb pin 32. This seat 40 on the loader sleeve 20 is sized so that the thumb pin 32 is received therein as the loader sleeve is received in operational assembly with the magazine 11 as shown in FIG. 2. Accordingly, and when the sleeve 20 is depressed in the direction shown by arrow 33 through use of a user's thumb on the sleeve's serrated thumb rest 41, the thumb pin 32 is entrapped in the loader sleeve's seat 40 and that downward force from the user's thumb onto the loader sleeve thereby depresses the thumb pin 32, and therefor the magazine's follower 26, against the compression spring 15. It is this loader sleeve 20 structure which allows the user to grasp the magazine 11 in one hand with the fingers of that one hand, and operate the loader sleeve, i.e., exert a force on the loader sleeve 20 as illustrated by arrow 33, with the thumb of that same hand so as to easily compress the magazine's follower 26 against the compression spring 15.

Now without the brake 21 of this invention, and if the loader sleeve 20 by itself was used as described in the above paragraph, if the user inadvertently released the loader sleeve 20 with no cartridges in the magazine 12 but with the follower 26 depressed against the compression spring 15, the resultant force exerted by the compression spring against the follower (and, thence, against the loader sleeve) might well cause the loader sleeve 20 to disengage from the open end of the magazine, i.e., might even cause the loader sleeve to fly off the open end of the magazine, And if this situation occurred, of course it could pose a potential safety problem to the user or to any person in the immediate vicinity of the user. It is toward overcoming this problem that applicant's invention is directed.

Now the loader sleeve 20 as described above is, in accord with the principles of this invention, combined with a brake 21 connected to that sleeve 20, The brake 21 co-acts with wall surface 37*a*, 37*b* of the magazine so as to impede the sleeve 20 and brake 21 from disengagement with the magazine 12 in the event the sleeve 20 is inadvertently released by a user at any location between an upper first position and a lower second position as that loader sleeve 20 is moved in the direction by arrow 33 to compress the spring 15 in order to permit easy reloading of the clip 11. In the first instance, the brake 21 co-acts with the sleeve 20 to cause the sleeve to slide in a frictional braking relation with the wall surface 37*b* of the magazine 12 as the sleeve slides from any lower second position to any upper position when the sleeve 20 is at the lower position and no cartridges are present in the clip, see FIG. 3. And in addition, the brake 21 co-acts itself with the wall surface 37*b* of the magazine 11 so as to slide itself in a frictional braking relation with that wall surface 37*b* as the sleeve 20 slides from a lower position to an upper position.

Figure 3:
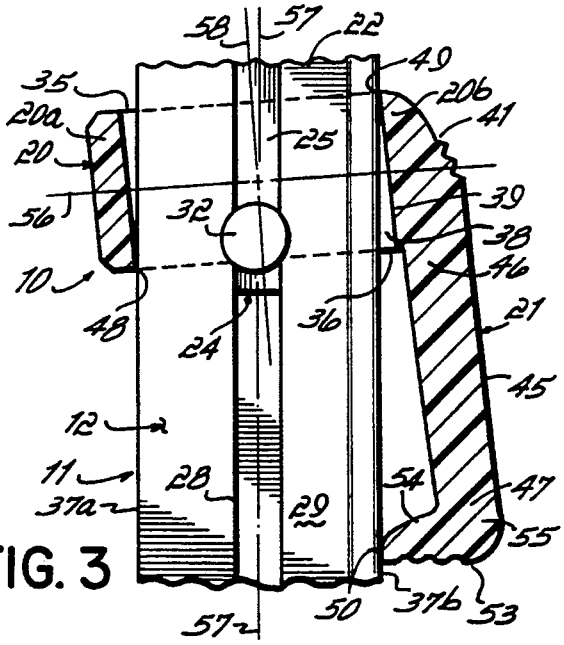
FIG. 3 is a cross-sectional enlarged view of the assembly shown in FIG. 2.

More specifically, the brake 21 is comprised of a brake arm 45 connected to the sleeve 20 at one end 46, and adapted to co-act with the magazine's wall surface 37*b* at its other end 47 as shown in FIG. 3. In this regard, the brake arm 45 is sized and configured so as to cock or tilt the loader sleeve 20 when the loader sleeve is assembled with the magazine 11 so that the bottom inner edge 48 of the loader sleeve's front wall 20*a* and the top inner edge 49 of the loader sleeve's back wall 20*b* are constantly frictionally engaged with the front 37*a* and rear 37*b* wall surfaces, respectively, of the magazine. In addition, and also as shown in FIG. 3, the brake arm 21 itself is in constant frictional contact as at with the rear wall 37*b* of the magazine 12. These three points 48, 49, 50 of frictional contact cooperate to provide a relatively high friction fit between the sleeve 20 on the one hand with the magazine's wall surfaces 37*a*, 37*b* and the brake arm 45 itself on the other hand with wall surface 37*b* so as to create a frictional sliding relationship between the sleeve 20 and brake 21 on the one hand and the magazine wall surfaces 37*a*, 37*b* on the other hand. This frictional braking relationship so created, while easily overcome when the loader sleeve 10 is being depressed against the compression spring 15 in a direction shown by arrow 33 due to pressure from a user's thumb as shown in FIG. 2, in fact co-acts with the magazine's wall surfaces 37*a*, 37*b* in the event no cartridges 16 are present in the clip 11 and the follower 26 is depressed when and if the loader sleeve is inadvertently released by the user so as to impede the sleeve from disengagement at a relatively high rate of speed with the magazine. And this, in turn, minimizes any safety problems that might otherwise occur. In this regard, the brake arm 45 preferably is fabricated from a resilient thermoplastic material in order that the brake arm function somewhat like a leaf spring in order to keep end 47 of the brake arm in contact with the magazine wall surface 37*b* with sufficient force so as to ensure that the loader sleeve's edges 48, 49 remain in frictional contact with the magazine when the sleeve is installed on it and with no force 33 as applied, all as shown in FIG. 3.

Figure 4:
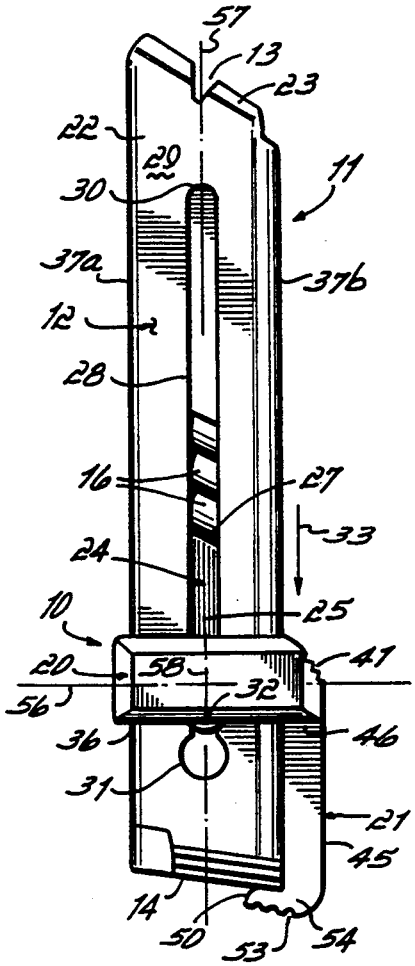
FIG. 4 is a view similar to FIG. 2 but showing the magazine cartridge reloader in latched relation with the cartridge clip.

The magazine cartridge loader 10 of this invention also includes a latch 53 connected to the sleeve 20, the latch being engageable with the magazine 11 when the sleeve has drawn the follower 26 to a full spring compression 15 position so as to hold the follower in that position during reloading of the magazine. In this regard, and as shown in FIG. 4, the latch 53 is connected to the brake arm 45 and is engageable with the magazine's closed end 14 when the sleeve 20 has drawn the follower 26 to a full spring compression position adjacent that closed end. The latch 53 is in the form of a latch foot 54 connected as at 55 with the brake arm 45 at an end 47 opposite to that end 46 at which the brake arm is connected to the sleeve 20. When the loader sleeve 20 achieves the full spring compression position, the latch foot 54 simply swings under the magazine's bottom end 14 into a latch position as shown in FIG. 4. In this latch position, it will be noted that the cross-sectional plane 56 of the sleeve 20 (i.e., that plane 56 which is normal to the sleeve axis 58) is at a different angular position relative to the longitudinal axis 57 of the magazine 12 than is the case when the latch foot 54 simply rides on the outer surface 37*b* of the magazine as shown in FIG. 3. In other words, and in the embodiment shown, when latched the loader sleeve plane 56 is substantially normal to the magazine's longitudinal axis 57 as shown in FIG. 4 whereas when in the frictional braking and non-latched position shown in FIG. 3 the loader sleeve plane 56 is at an acute angle relative to that magazine longitudinal axis 57.

Having described in detail the preferred embodiment of my invention, what I desire to claim and protect by Letters Patent is:

1. A cartridge loader for a cartridge clip, said clip being of the type having a magazine with a follower biased toward an ejection end by a compression spring, and a thumb pin fixed to said follower extending through a slot located in a sidewall of said magazine, said follower being drawn down toward a closed end of said magazine against said compression spring by pushing said pin toward said closed end, said cartridge loader comprising:

a loader sleeve slidingly receivable on said magazine, said sleeve being slideable on said magazine from a first position to a second position to compress said spring in order to permit easy re-loading of said clip, said sleeve co-acting with said thumb pin as said sleeve slides from said first to said second position, and a brake connected to said sleeve, said brake co-acting with a wall surface of said magazine so as to impede said sleeve from disengagement with said magazine in the event said sleeve is inadvertently released by a user at any location between said first and second positions when no cartridges are present in said clip.

2. A cartridge loader as set forth in claim 1, said brake co-acting with said sleeve to cause said sleeve to slide in a frictional braking relation with a wall surface of said magazine as said sleeve slides from said second to said first position when said sleeve is at said second position and no cartridges are present in said clip.

3. A cartridge loader as set forth in claim 2, said sleeve having cross-sectional configuration and dimensions, relative to cross-sectional configuration and dimensions of said magazine, that would allow said sleeve to slide freely along said magazine wall surface if said brake did not co-act with said wall surface.

4. A cartridge loader as set forth in claim 2, said brake coacting with a wall surface of said magazine so as to slide itself in a frictional braking relation with said wall surface as said sleeve slides from said second to said first position.

5. A cartridge loader as set forth in claim 1, said brake co-acting with a wall surface of said magazine so as to slide itself in a frictional braking relation with said wall surface as said sleeve slides from said second to said first position.

6. A cartridge loader as set forth in claim 1, said brake comprising:

a brake arm connected to said sleeve at one end, and adapted to co-act with said magazine wall surface.

7. A cartridge loader as set forth in claim 1, said loader comprising:

a latch connected to said sleeve, said latch being engageable with said magazine when said sleeve has drawn said follower to a full spring compression position so as to hold said follower in said full spring compression location.

8. A cartridge loader as set forth in claim 6, said brake comprising:

a latch connected to said brake arm, said latch being engageable with said magazine's closed end when said sleeve has drawn said follower to a full spring compression position adjacent said closed end so as to hold said follower in said full spring compression location.

9. A cartridge loader as set forth in claim 8, said latch comprising:

a latch foot connected with said latch brake arm at an end opposite to that at which said brake arm is connected to said sleeve.

10. A cartridge loader as set forth in claim 1, said loader comprising a thumb rest located on said sleeve, said thumb rest allowing said magazine to be griped in the palm of a user's hand and said sleeve operated by the user's thumb.

* * * * *

UNITED STATES PATENT AND TRADEMARK OFFICE

CERTIFICATE OF CORRECTION

PATENT NO. : 5,402,594

DATED : April 4, 1995

INVENTOR(S) : R.D, Switzer

It is certified that error appears in the above-identified patent and that said Letters Patent is hereby corrected as shown below:

At Column 6, line 36 please delete "latch" (2nd occurrence).

Signed and Sealed this

Twelfth Day of September, 1995

*Attest:*

Bruce Lehman

BRUCE LEHMAN

*Attesting Officer*

*Commissioner of Patents and Trademarks*